United States Patent [19]

Lewis et al.

[11] Patent Number: 4,848,772

[45] Date of Patent: Jul. 18, 1989

[54] FOLDABLE GAME BOARD

[76] Inventors: Tedford P. Lewis, 415 W. Kirkham, Webster Groves, Mo. 63119; Gail B. Schwarz, 3613 N. 19th St., St. Louis, Mo. 63119; Amanda M. Smith; Arthur B. Smith, both of 8642 North Ave., St. John, Mo. 63114

[21] Appl. No.: 155,874

[22] Filed: Feb. 16, 1988

[51] Int. Cl.[4] ..... A63F 3/00

[52] U.S. Cl. ..... 273/286

[58] Field of Search ..... 273/286, 285, 287; 206/315.1, 579

[56] References Cited

U.S. PATENT DOCUMENTS

| | | | |
|---|---|---|---|
| 2,729,451 | 1/1956 | Larson | 273/285 |
| 3,534,961 | 10/1970 | Tiley | 273/286 |

FOREIGN PATENT DOCUMENTS

| | | | |
|---|---|---|---|
| 2223956 | 10/1974 | France | 273/286 |
| 116825 | 6/1918 | United Kingdom | 273/286 |

*Primary Examiner*—Edward M. Coven

*Assistant Examiner*—Benjamin Layno

*Attorney, Agent, or Firm*—Gravely, Lieder & Woodruff

[57] ABSTRACT

A parlor game is played on a mat having a rectangular playing panel on which a playing field is marked and a pocket located along and extending from one margin of the playing panel. Along its margins, the playing panel is fitted with stiffening bars which have their ends mitered to conform to each other at the corners of the panel. The bars, when the playing panel is spread over a supporting surface, maintain the panel in an open condition and prevent it from gathering when playing pieces are moved over its playing field. These playing pieces fit into the pockets when the game is not in progress. While the mitered ends of the stiffening bars are adjacent, they are nevertheless detached, and this enables the playing panel to fold along diagonal lines that pass between the mitered ends of adjacent stiffening bars. Indeed, the playing panel folds into a highly compact triangular form, whereupon the pocket, with the playing pieces in it, is folded over onto the folded playing panel, and the folded playing panel and pocket are rolled into a tight bundle.

19 Claims, 2 Drawing Sheets

FOLDABLE GAME BOARD

BACKGROUND OF THE INVENTION

This invention relates in general to parlor games and more particularly to equipment for playing parlor games.

Many parlor games require a game board and playing pieces which during the course of the game are moved over a playing field which is imprinted on the board. Typically, the board is formed from a rigid material, such as thick paperboard, and possesses one or more fold lines which enable the board to assume a more compact, although flat, configuration when stored. The playing pieces are often quite small and molded from plastic, and as a consequence may be difficult to grasp. Such equipment comes packaged in a box in which it is stored when not in use. While the board folds to conform to the box, a game board can accomodate only limited folds before it loses its rigidity. As a consequence, the boxes for parlor games are usually quite large. They must also have some depth to accomodate the playing pieces. As a result, the equipment for a typical parlor game consumes excessive shelf space and is otherwise difficult to store. Moreover, the lids are rarely secure, and once opened, the playing pieces can easily spill out and become lost. The paperboard of the typical game board is not very durable and unless handled carefully will bend and leave the board with an unsightly crease. In time the paper appears soiled and worn.

The game equipment of the present invention utilizes a playing field which is imprinted on a fabric playing panel, and while the fabric panel remains flat and otherwise retains the shape of the field when it is spread out on a supporting surface, such as a table top, to play the game, it may thereafter be converted into a highly compact roll or bundle that is easily stored in a drawer, on a shelf or packed in travel luggage. The roll not only contains the playing field, but the playing pieces as well, for they are received in fabric pockets which are attached to the playing panel and fold over onto it.

DESCRIPTION OF THE DRAWINGS

In the accompanying drawings which form part of the specification and wherein like numerals and letters refer to like parts wherever they occur

DETAILED DESCRIPTION

Figure 4:
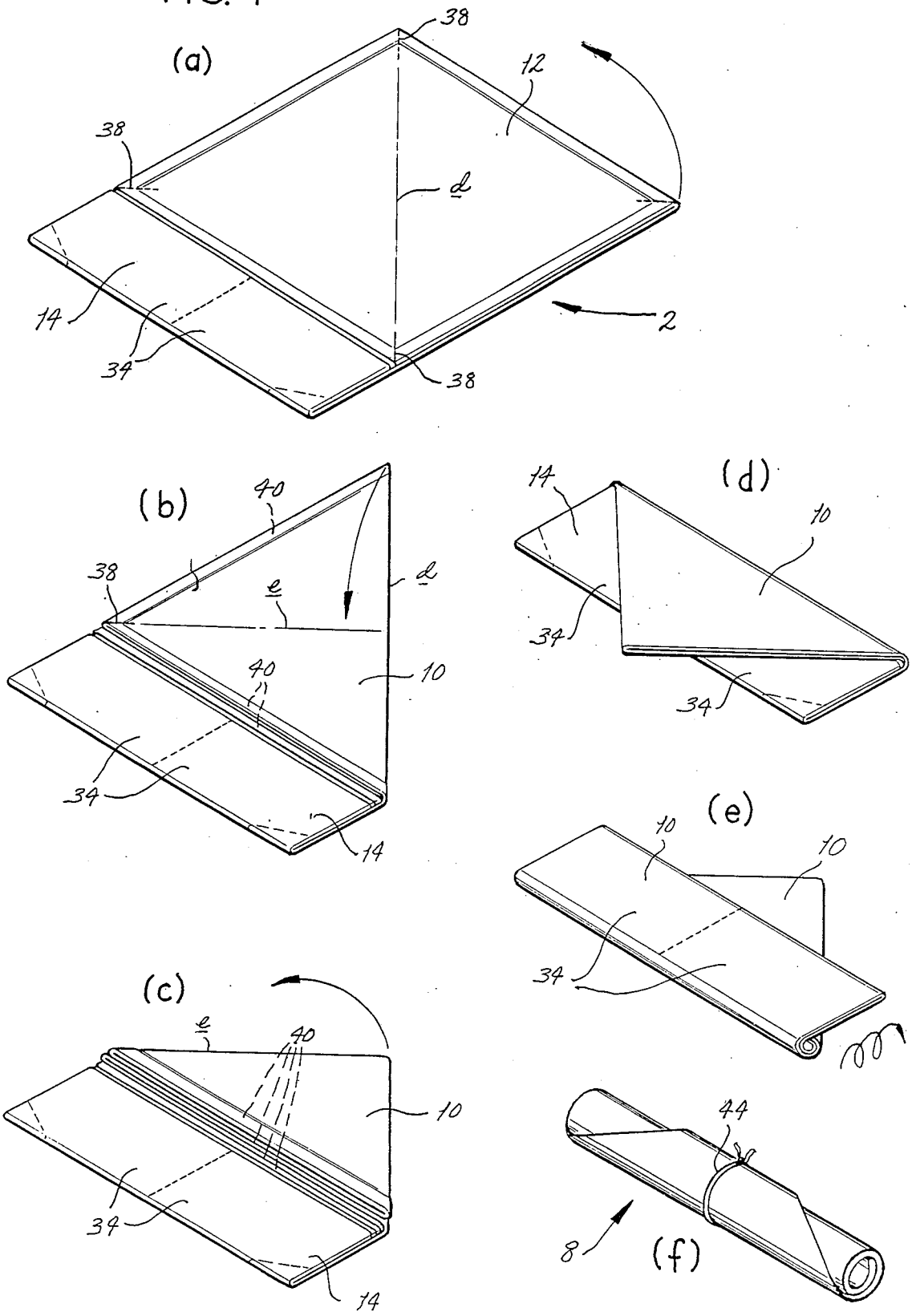
FIGS. 4(*a*)–4(*f*) are views sequentially showing the steps undertaken to convert the mat from its open position to a roll or bundle.

Referring now to the drawings, the equipment for playing a parlor game includes a flexible mat 2 (FIG. 1) having a playing field 4 imprinted on it and a plurality of playing pieces 6 which are moved over the playing field 4 when the game is in use. The mat 2, with the playing pieces 6 retained in pockets, is easily rolled into a bundle 8 (FIG. 4/) which is conveniently stored in a drawer or on a shelf or carried in a briefcase or other luggage, and when so stored or carried, occupies very little room—certainly a lot less than a box containing the equipment for a typical board-type parlor game. These characteristics obviate the need for a mini-version of the equipment. Indeed, the flexible mat 4 is lighter and more easily carried and utilized than most miniaturized game boards.

Figure 2:
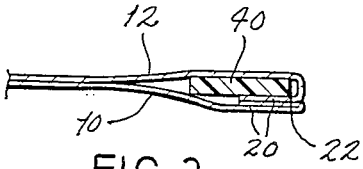
FIG. 2 is a sectional view taken along line 2—2 of FIG. 1 and showing one of the stiffening bars and the seam along that bar.
Figure 3:
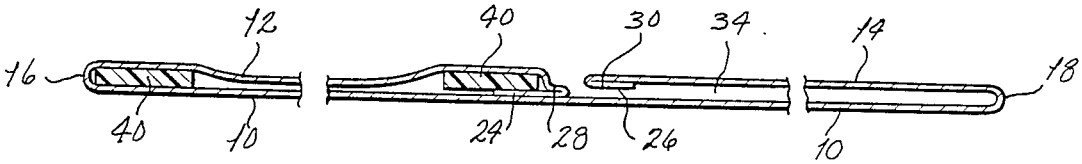
FIG. 3 is a sectional view taken along line 3—3 of FIG. 1 and showing the several panels which comprise the mat as well as some of the stiffening bars.

The mat 2 is, of course, flexible, and to this end it should be formed from a flexible sheet material, a fabric being preferred. One suitable fabric is a heavy poplin containing 65% polyester and 35% cotton. This fabric is doubled back upon itself from both ends to provide a back panel 10, a playing panel 12, and a pocket panel 14 (FIG. 3). Indeed, the playing panel 12 and pocket panel 14 overlie the entire back panel 10, the former being joined to the back panel 10 along a fold line 16 and the latter along a fold line 18. All three panels 10, 12 and 14 are turned inwardly along their sides to provide seam allowances 20 (FIG. 2), and the back panel 10 is further joined to the playing panel 12 and pocket panel 14 at lines 22 of stitching which extend through the seam allowances 20. The playing and pocket panels 12 and 14 do not overlap each other, but they do come up to each other where they turn under in the form of more seam allowances 24 and 26, respectively (FIG. 3). The playing panel 12 is secured to the back panel 10 at its seam allowance 24 by a line of stitching 28 which follows the lower margin of the playing panel 12.

On the other hand, the seam allowance 26 of the pocket panel 14 is secured only to the pocket panel 14 itself along another line 30 (FIG. 3) of stitching which follows the upper margin of the pocket panel 14, and thus the pocket panel 14 in this region remains detached from the back panel 10. The pocket panel 14, however, is attached to the back panel 10 along a line 32 (FIG. 1) of center stitching which extends from the fold 18 to the line 24 of stitching midway between the lines of stitching 22 at the sides of the pocket panel 14. This creates two pockets 34 which open out of the mat 2 along the upper margin of the pocket panel 14. The interior of each pocket 34, of course, lies between the back panel 10 and the pocket panel 14 and is closed at its sides by the lines 22 and 32 of stitching and at its bottom by the fold 18. The upper margins of the pockets 34 are of course the upper margin of the pocket panel 14 and that margin lies along the bottom margin of the playing panel 12 so that the exposed surfaces of the playing and pocket panels 12 and 14 are generally flush. Indeed, along those adjacent margins the pocket panel 14 and playing panel 12 are joined to each other as well as to the back panel 10 by lock stitches 36 (FIG. 1) which reinforce the pockets 34. Since the line 32 of center stitching extends all the way to the line 30 of stitching along the open ends of the pocket 34, the line 32 of stitching together with the center lock stitches 36 serve to hold the pockets 34 closed, that is, they hold the free ends of the pockets 34 close to the lower margin of the playing panel 12. Of course the pocket panel 14 may be divided into more pockets 34 simply by providing additional lines 32 of stitching. The pockets 34 hold the playing pieces 6 when they are not in use and are quite flexible to conform to those pieces. They also roll closed when the mat 2 is transformed into the bundle 8, and any playing pieces 6 which are in them are thus trapped and cannot spill from the bundle 8.

To prevent the playing pieces 6 from collecting in the outside corners of the two pockets 34, particularly when the mat 2 is rolled into the bundle 8, the pockets 34 may be provided with lines 37 of diagonal stitching which in effect close the outer corners of the pockets 34.

While the pockets 34 are quite flexible, the portion of the mat 2 on which the playing field 4 exists is not. This, of course, constitutes the portion occupied by the playing panel 12. To this end, the playing panel 12 and the back panel 10, aside from being joined together at the lines 22 of side stitching, the fold 16 and the line 28 of bottom stitching, are further joined along lines 38 (FIG. 1) of diagonal stitching which extend diagonally inwardly from the four corners of the playing panel 12 for a short distance—about 1½ inches. Indeed, at each corner two parallel lines 38 of diagonal stitching exist, and those lines are spaced about 1/16 inches apart. The lines 38 of diagonal stitching bisect the corners at which they lie, that is to say, each is oriented at 45° with respect to the two margins between which they exist. Along each of its four margins c, the playing panel 12 is rigidified with a flat stiffening bar 40 having mitered ends 42 which conform to the lines 38 of diagonal stitching. Each bar 40 is captured between the back and playing panels 10 and 12 and extends substantially the full distance between the lines 38 of diagonal stitching between which it lies. Indeed, one of its mitered ends lies along one of those lines 38, while the other lies along the other line 38. The fit is such that the bar 40, cannot be displaced inwardly toward the center of the panel 12 unless bowed significantly and slipped through the space between the two panels 10 and 12. Likewise, the margin itself prevents the bar 40 from being displaced outwardly, irrespective of whether the margin is secured with one of the lines 22 or 28 of stitching or by the fold 16. The stiffening bars 40, while possessing substantially greater rigidity than the fabric of the mat 2, have the capacity to flex. Any number of flexible polymers are suitable for the bars 40. For the typical mat 2 each bar 40 in cross-section measures about 3/32×¾ inches and is formed from polyvinyl chloride.

The flexibility of the bars 40 enables them to be fitted into their respective positions between the back and playing panels 10 and 12. In this regard, the line of stitching 22 along one of the sides of the playing panel 12 is interrupted to provide a gap only slightly wider than the width of the stiffening bars. Each of the bars 40 is fed through this gap into the space between the two panels 10 and 12. Within the space, the bars 40 are bent within the elastic limit of the material from which they are formed and are maneuvered into their respective positions along the four margins of the playing panel 12, that is to say, they are bent to fit between the diagonal lines 38 of stitching at the ends of those margins and then released so that their mitered ends 42 come up to the diagonal lines 38 of stitching.

The lines 38 of diagonal stitching separate the ends 42 of adjacent bars 40, and while the ends 42 come up to the lines 38 of stitching, they do not crowd that stitching to the point that the mat 2 cannot be folded along the lines 38 of stitching. Indeed, the lines 38 of stitching provide locations at which the mat 2 is folded without imparting undue stress to the fabric of the panels 10 and 12 or the lines 22 and 38 which join them together. This folding permits the mat 2 to be reduced to a more compact form, that is, to the bundle 8. First, playing panel 12 and underlying portion of the back panel 10 are folded along a diagonal d (FIG. 4*a*) that includes two lines 38 at opposite corners of the panel 12. This brings the bar 40 along one of the side margins of the panel 12 over the bar 40 along the bottom margin, and the bar 40 along the top margin over the bar 40 at the other side margin, so the other two corners come together, with one overlying the other (FIG. 4*b*). Then the panel 12 and corresponding portion of the panel 10 are again folded, this time along a fold line e that extends through the lines 38 of stitching at the adjacent corners. This fold brings all four bars 40 together so that they form a stack along the adjacent margins of the playing and pocket panels 12 and 14, that is along the openings into the pockets 34 (FIG. 4*c*). These folds constitute the initial steps of converting the opened mat 2 into the bundle 8.

To complete the conversion, the folded playing panel 12 and corresponding portion of the back panel 10 are brought upwardly and folded over the pocket panel 14 and underlying portion of the back panel 10, the fold being along the openings of the pockets 34 so as to effectively close those pockets 34 (FIG. 4*d*). Indeed, when the playing panel 12 is folded along the lines d and e, the four bars 40 lie along the openings to the pockets 34 and establish a very effective barrier at the entrances to the pockets 34. Thereafter, the folded panels 10, 12 and 14 are merely rolled up beginning at the pockets 34 and the stacked stiffening bars 40 to create a roll which is the bundle 8 (FIG. 4*f*). Within this roll or bundle 8, the back face of the back panel 10 is presented outwardly, and to it a tie 44 is secured by stitches. The tie 44 retains the mat 2 in the rolled configuration of the bundle 8. Other fastening devices, such as a rubber band or Velcro patches, may be used to hold the bundle 8 closed. Variations of this folding scheme may be used with equal success, so the person converting the mat 2 into the bundle 8 need not remember a specific sequence. A trademark for the game and its equipment may be applied to the mat 2 such that it is exposed when the mat is converted to the bundle 8.

The playing field 4 appears on the playing panel 12 (FIG. 1) and may be applied to it by using conventional procedures for applying markings to fabrics, such as the silk screen stenciling process. Use of sublimation or die inks for the marking accommodates the rolling and folding with minimal damage and further offers the least resistance to movement of the playing pieces 6 over the playing panel 12. The playing field 4 for the game illustrated derives from an East Indian game, but the playing panel 12 lends itself to other playing fields as well, irrespective of whether they are rectangular or any other planar shape. For example, the multitude of squares that make up the playing field for the game of checkers may be applied to the playing panel 12. The directions for the game to which the playing field 4 pertains may be applied to the pocket panel 14 where they are visible directly below the playing field 4. Another playing field for a different game may be printed on the portion of the back panel 10 that is behind the playing panel 12. Also, another playing panel for still another game may be laid over and attached to the playing panel 12 with Velcro fastening pads.

Figure 1:
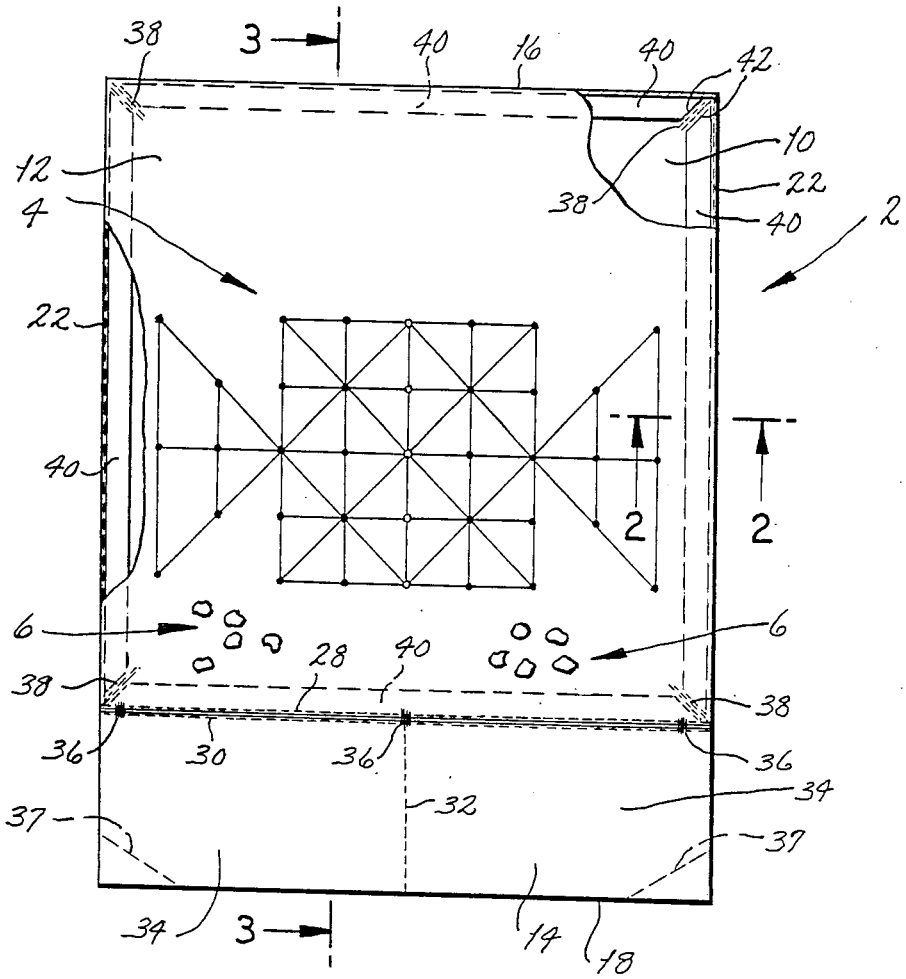
FIG. 1 is a plan view of an opened mat suitable for use in playing a parlor game.

The playing pieces 6 are relatively small, they being of a size suitable for movement over the playing field 4 during the course of the game (FIG. 1). The playing pieces 6 should also be small enough to fit into the pockets 34 when not in use. In most games the playing pieces 6 will fall into two or more groups distinguishable from each other by color or shape.

In the case of the game to which the illustrated playing field 4 pertains, the playing pieces 6 are pebbles of two different colors, and as such they are less likely than light weight plastic playing pieces to be displaced or lost. The pocket panel 14 and the underlying portion of the back panel 10 may be divided into more than two pockets 34 if the playing pieces 6 fall into more than two groups.

To play the parlor game, the players spread the mat 2 over a supporting surface, such as a table top, with the playing panel 12 and pocket panel 14 presented upwardly. The bars 40, being lodged between the lines 38 of diagonal stitching at the corners of the playing panel 12, hold the playing panel 12 open and indeed impart enough rigidity to it to enable it to be used on surfaces as small as the fold down tables in commercial aircraft. Since the mat has only soft fabric exposed on both of its faces, it will not mar the finishes on fine furniture. Once the mat 2 is spread, the players withdraw the playing pieces 6 from the pockets 34 and place them on the playing panel 12 at the appropriate locations over the playing field 4. Then the players move the playing pieces 6 over the playing field 4 in accordance with the rules of the game. During the many moves the playing panel 12 remains perfectly flat, for the stiffening bars 40 along the margins of that panel hold the margins squared with respect to each other and prevent the panel 12 from gathering. In effect, the stiffening bars 40 serve as a frame for maintaining the playing panel 12 in its rectangular configuration. Moreover, the bar 40 along the bottom margin of the playing panel 12 keeps the free margin of the pocket panel 14, which is of course along the entrance to the pockets 34, straight, and they likewise do not gather. Indeed, the pocket panel 14 remains spread adjacent to the playing panel 12 with its free margin located along the bottom margin of the playing panel 12, so that it is difficult to discern any break between the two panels 12 and 14.

Some games, such as checkers and backgammon, require removal of the playing pieces 6 from the playing field 4 as the game progresses. The pieces 6 may be placed in the pockets 34 as they are removed to avoid their subsequent loss. In any event, at the conclusion of the game, the players gather any lose playing pieces 6 on the playing panel 12 where they are segregated into the appropriate groups. The free margin of the pocket panel 14 is then lifted slightly away from the back panel 10 and the playing pieces 6 are brushed into the open pockets 34, with each group of pieces 6 being consigned to a different pocket 34. The playing pieces 6 are urged to the bottoms of their respective pockets 34, that is toward the fold 18 between the backing panel 10 and the pocket panel 14.

Once the playing pieces 6 are in their respective pockets 34, the remaining portion of the mat 2, that is the playing panel 12 and the underlying portion of the back panel 10, is folded into a compact triangular configuration adjacent to the pocket panel 14. To this end, the mat 2 is grasped at one of its corners remote from the pocket panel 14 and that corner is brought upwardly (FIG. 4*a*) and over to the diagonally opposite corner which is along the pocket panel 14 (FIG. 4*b*). Being rigidified along its four margins by the stiffening bars 40, the only location at which the playing panel 12 can accommodate this movement is at the remaining two corners, and indeed the playing panel 12 and underlying portion of the backing panel 10 fold along the diagonal line d that extends between those two corners. The lines 38 of diagonal stitching at those corners lie along the fold line d. With the panels 10 and 12 so folded, the bar 40 formerly at one side of the playing panel 12 lies over the bar 40 at the bottom of the panel 12, that is the bar 40 which is along the pocket panel 14, while the bar 40 formerly at the top of the panel 12 lies over the bar 40 along the other side of the panel 12. The panel 12 and corresponding portion of the backing panel 10 thus acquire a triangular configuration. Next, the folded panels 10 and 12 are grasped at the folded corner remote from the pocket panel 14 (FIG. 4*b*), and that corner is brought down to the other folded corner which is located along the pocket panel 14 (FIG. 4*c*). The folded panels 10 and 12 thus acquire another fold line e, and this fold line follows the diagonal lines of stitching 38 at the two corners which were first brought together. As a result, the bars 40 which were formerly directed away from the pocket panel 14, now lie along the pocket panel 14, indeed over the remaining two bars 40. The playing panel 12 and the corresponding portion of the backing panel 10 now assume a smaller triangular configuration, with two of the apexes for that triangle being located at the pocket panel 14, that is at the ends of the four stacked bars 40, and the remaining apex being located remote and projecting away from the bars 40.

Once the playing panel 12 and corresponding portion of the back panel 10 are folded into a highly compact triangular form, they are brought upwardly and folded over the pocket panel 14 and the corresponding portion of the back panel 10, so that the stacked stiffening bars 40 lie against the pocket panel 14 and close the open ends of the pockets 34. The mat 2 thus assumes an even more compact configuration (FIG. 4*d*). Then this configuration is turned over (FIG. 4*e*) and rolled up into the bundle 8, with the rolling beginning at the stacked bars 40 and proceeding through the pockets 34 to the remote apex of the folded playing panel 12 and corresponding portion of the backing panel 10 (FIG. 4*f*). The pockets 34 acquire at least one fold ahead of the playing pieces 6 which collect near the fold 18 between the back panel 10 and pocket panel 14, and thus the playing pieces cannot be dislodged from the pockets 34. Other folding and rolling sequences are available to convert the mat 2 into the bundle 8.

Finally the rolled bundle 8 is secured with the tie 44 or some other securing device to insure that the bundle 8 does not unravel.

The bundle 8 is most compact and requires very little storage space—certainly substantially less than a paperboard game board conventionally packaged in a box. As such, it fits easily into a drawer or onto a shelf and furthermore packs easily in luggage or a briefcase, should one desire to play the game while on a trip. The fabric from which the mat 2 is formed is considerably more durable than the paperboard of conventional game boards.

Figure 5:
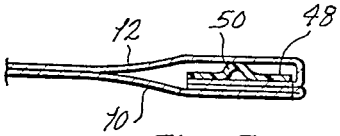
FIG. 5 is a sectional view similar to FIG. 2, but showing a modified stiffening bar.

In lieu of the stiffening bars 40 of rectangular cross section, the playing panel 12 may be rigidified, when open, with somewhat thinner stiffening bars 48 having longitudinally directed ribs 50 incorporated into them (FIG. 5).

This invention is intended to cover all changes and modifications of the example of the invention herein chosen for purposes of the disclosure which do not constitute departures from the spirit and scope of the invention.

What is claimed is:

1. For use in playing a parlor game, a mat comprising: a playing panel of polygonal shape formed from a flexible sheet material that is capable of being folded and having margins and a playing field marked on it within the margins; and stiffening bars located along the margins of the panel and having their ends adjacent to each other, there being a separate bar along each margin, with each bar extending substantially the full length of the margin along which it lies and being captured with respect to the playing panel so that it remains in place along its margin, the bars being arranged along the panel such that they hold the panel in an open spread position, the ends of the bars being located such that the panel can be folded into a compact configuration along fold lines that extend between corners of the polygonal shape.

2. The mat according to claim 1 and further comprising at least one pocket located along one of the margins of the playing panel.

3. The mat according to claim 2 wherein pocket has an opening that is along that margin of the playing panel to which the pocket is attached.

4. A process for converting the mat of claim 3 into a compact bundle, said process comprising: folding the playing panel over onto itself along a line that extends between two of its corners so that the panel assumes a smaller shape in which the stiffening bars overlie each other along two margins of that shape, which margins also meet at a corner; again folding the playing panel over onto itself along a fold line that passes through the corner formed by the overlying stiffening bars so that the panel forms a still smaller shape in which the stiffening bars are in a stack along the pocket, folding the pocket over the stacked stiffening bars and onto the folded panel; and rolling the mat into a bundle, with the rolling beginning essentially at the stacked stiffening bars.

5. The mat according to claim 2 in combination with a plurality of playing pieces which are configured to be moved over the playing field in the course of the game and are small enough to fit into the pockets.

6. The mat according to claim 1 wherein the playing panel is rectangular in shape.

7. The mat according to claim 1 and further comprising a back panel attached to playing panel and covering the face of the playing panel opposite from that on which the playing field appears, the back panel extending beyond one margin of the playing panel, and a pocket panel lying over the portion of the back panel which projects beyond the margin so as to form at least one pocket along the playing margin; the back panel and pocket panel also being formed from a flexible sheet material that is capable of being folded.

8. The mat according to claim 7 wherein the pocket panel is detached from the back panel and playing panel along that margin of the playing panel beyond which the back panel extends, so as to provide an opening into the pocket.

9. The mat according to claim 7 wherein the stiffening bars are captured between the back and playing panels.

10. The mat according to claim 9 wherein the back and playing panels are joined together along their margins and along lines which extend inwardly from the corners of the playing field toward the center of the playing field, and wherein the bars extend out to and have their ends at the lines where the playing and back panels are joined at the corners of the playing panel.

11. The mat according to claim 10 wherein the lines along which the playing and back panels are joined generally bisect the corners of the playing panel.

12. The mat according to claim 10 wherein the playing panel is rectangular; wherein the lines at which the playing and back panels are joined generally bisect the corners of the playing panel; and wherein the ends of the bars are mitered to conform to the lines, whereby the bars cannot be displaced inwardly into the space between the playing and back panels.

13. The mat according to claim 12 wherein the playing, pocket and back panels are formed from a single sheet of fabric which is folded over onto the back panel at two folds to provide the playing and pocket panels.

14. The mat according to claim 1 and further comprising another panel generally located against the playing panel; and wherein the stiffening bars are captured between the playing panel and the other panel.

15. The combination comprising: a mat including a rectangular playing panel formed from a flexible sheet material and having a playing field marked on it; a flexible pocket connected to the playing panel at one margin thereof and extending beyond the playing panel; and stiffening bars located along the margins of the playing panel such that they are prevented from being displaced outwardly with respect to the panel, there being a separate bar along each margin of the panel with each bar extending substantially the full length of the margin along which it lies, the bars extending out to the corners of the panel and having their ends at those corners, whereby the bars, when the playing panel is spread onto a flat surface, prevent the panel from gathering, the ends of the stiffening bars being substantially detached from each other at the corners so that the panel can fold along fold lines that pass between the ends of adjacent stiffening bars; and playing pieces of a size suitable for moving over the playing field during the course of the game and for further fitting into and being stored in the pocket when the game is not in use.

16. The combination according to claim 15 wherein the mat further includes a back panel which is located behind the playing panel and further extends beyond one margin of the playing panel, and a pocket panel overlying and being secured to the portion of the back panel that is beyond the playing panel such that the pocket panel and corresponding portion of the back panel form the pocket.

17. The combination according to claim 16 wherein the playing panel is attached to the back panel along the margins of the playing panel and the stiffening bars are between the playing and back panels.

18. The combination according to claim 17 wherein the playing panel is also attached to the back panel along lines that extend between the ends of adjacent stiffening bars.

19. A process for converting the mat of claim 15 into a compact bundle, said process comprising: folding the playing panel over onto itself along a line that extends between two of its corners so that the panel assumes a triangular shape in which the stiffening bars overlie each other along two margins of that shape; again folding the playing panel over onto itself along a fold line that passes through the corner formed by the overlying stiffening bars so that the panel forms a smaller triangular shape in which all of the stiffening bars are in a stack along the pocket, folding the pocket over the stacked stiffening bars and onto the folded panel; and rolling the mat into a bundle, with the rolling beginning essentially at the stacked stiffening bars.

* * * * *